US006520446B2

(12) United States Patent
Eugster

(10) Patent No.: US 6,520,446 B2
(45) Date of Patent: Feb. 18, 2003

(54) DEVICE FOR WINDING AND UNWINDING FLAT PRINTED SHEETS ONTO OR FROM A ROTARY WINDING DRUM

(75) Inventor: Albert Eugster, Strengelbach (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/854,207

(22) Filed: May 11, 2001

(65) Prior Publication Data

US 2001/0042809 A1 Nov. 22, 2001

(30) Foreign Application Priority Data

May 17, 2000 (EP) ..... 00810429

(51) Int. Cl.[7] ..... B65H 39/14; B65H 18/10; B65H 26/00

(52) U.S. Cl. ..... 242/528; 242/534; 242/563

(58) Field of Search ..... 242/528, 534, 242/534.2, 563, 563.2, 333; 254/271

(56) References Cited

U.S. PATENT DOCUMENTS

| | | | | |
|---|---|---|---|---|
| 1,254,631 A | * | 1/1918 | Shepard | 254/271 |
| 3,016,244 A | * | 1/1962 | Schuh et al. | 242/333 |
| 3,632,052 A | * | 1/1972 | Read | 242/534.2 |
| 3,850,380 A | * | 11/1974 | Kranefeld | 242/563.2 |
| 4,589,603 A | * | 5/1986 | Muller | 242/528 |

FOREIGN PATENT DOCUMENTS

| | | |
|---|---|---|
| CH | 682657 | 10/1993 |
| DE | 2726855 | 5/1979 |
| EP | 0447903 | 9/1991 |
| EP | 0529764 | 3/1993 |
| EP | 0710569 | 5/1996 |
| EP | 0739838 | 10/1996 |
| EP | 0826616 | 3/1998 |

OTHER PUBLICATIONS

Patent Abstracts of Japan, vol. 010, No. 025 (M–450), Jan. 31, 1986 & JP 60 183457 A (Fuji Xerox KK), Sep. 18, 1985.

* cited by examiner

*Primary Examiner*—John M. Jillions
(74) *Attorney, Agent, or Firm*—Friedrich Kueffner

(57) ABSTRACT

A winding device for flat printed sheets has a rotatably supported winding drum for receiving and dispensing printed sheets. At least one winding mandrel having a winding belt wound thereon and configured to unwind the winding belt and feed undershot the winding belt to the winding drum is provided. The winding belt receives the printed sheets and, by being wound onto the winding drum together with the printed sheets, forms winding layers of the printed sheets on the winding drum. A touch probe detects an empty state of the winding drum, without printed sheets wound thereon, or a loaded state of the winding drum, having printed sheets wound thereon, by interacting with the winding belt or the printed sheets.

5 Claims, 2 Drawing Sheets

DEVICE FOR WINDING AND UNWINDING FLAT PRINTED SHEETS ONTO OR FROM A ROTARY WINDING DRUM

BACKGROUND OF THE INVENTION

1. Field of the Invention

The invention relates to a device for winding and unwinding flat printed sheets onto or from a rotary winding drum. The winding drum has correlated therewith at least one winding belt for forming wound layers of printed sheets. The winding belt is removable from a winding mandrel and fed undershot to the winding drum. Means are provided for detecting the loading of the winding drum with regard to printed sheets.

2. Description of the Related Art

Devices of the aforementioned kind are well known in the printing industry as space-saving and inexpensive means for winding and unwinding printed sheets of newspapers and magazines. The winding of printed sheets onto the winding drum serves inter alia for intermediate storage, for transport and/or further processing of the printed sheets in an overlapped arrangement.

Prior art references disclosing such devices are CH 682 657 A5, EP 0 739 838 A2 as well as EP 0 826 616 A1 owned by the assignee.

For controlling the paper supply, it is required that during unwinding of the winding drum the empty state is reliably detected in a timely fashion. When the empty state is not recognized in a timely fashion, there is the risk that the winding belt is torn off. In the prior art, the recognition of the empty state is realized by optically or electrically detectable belt markings which are provided on the winding belt. An electrically detectable belt marking is, for example, a metal plate which is glued onto the winding belt or is otherwise fastened thereto. Such belt markings, however, can become ineffective during use by soiling or by being damaged. In order to prevent this, the winding belts must be checked and, if needed, replaced. Moreover, for recognizing belt markings it is often necessary to wind the winding belt back and forth which results in a considerable prolongation of the cycle time.

SUMMARY OF THE INVENTION

It is an object of the present invention to provide a device of the aforementioned kind which ensures a reliable but still inexpensive detection of loading of a winding drum.

In accordance with the present invention, this is achieved in that the means for detection comprise a touch probe which cooperates with the winding belt or the printed sheets and indicates whether the winding drum is empty or loaded.

In the device according to the invention, the touch probe is arranged on the winding drum and is thus not a component of the winding belt. The attachment of the touch probe on the winding drum is considerably simpler and less damage-prone than the attachment of a belt marking on the winding belt which belt is comparatively narrow and made of plastic material.

The touch probe can be realized in an especially simple way by a lever which can be supported in a springy fashion in a cutout at the periphery of the winding drum.

Preferably, this lever has, at a spacing to its pivot axle, a nose which projects, when the winding drum is empty, past the mantle surface of the winding drum and, when the winding drum is loaded, is moved radially inwardly by the winding belt or by the printed sheets against a restoring force of the spring.

When the winding drum is empty, the nose of the touch probe thus projects radially outwardly, while, when the winding drum is covered or loaded with printed sheets, this nose is pressed radially inwardly. The lever can thus have two positions wherein one position indicates the empty state and the other position the loaded state.

These two positions are detected in an advantageous manner according to a further development of the invention by means of a photocell. The detection is realized preferably by a light beam which impinges axis-parallel into the winding drum.

According to a further embodiment of the invention, the touch probe is arranged in the circumferential direction of the winding drum at a comparatively short spacing before the leading end of the winding belt. The empty state is already indicated when there is still a residual length of winding belt, respectively, of the winding layer present. The winding drum is thus still partially surrounded, for example, over half its circumference by the winding belt or the printed sheets. The unwinding process can thus be interrupted reliably and in a timely fashion. This ensures that the winding belt is not torn off the winding drum. During winding onto the winding drum, the loaded state is indicated as soon as the winding belt or the printed sheets applied in an overlapped arrangement have reached the touch probe.

DESCRIPTION OF THE PREFERRED EMBODIMENTS

Figure 1:
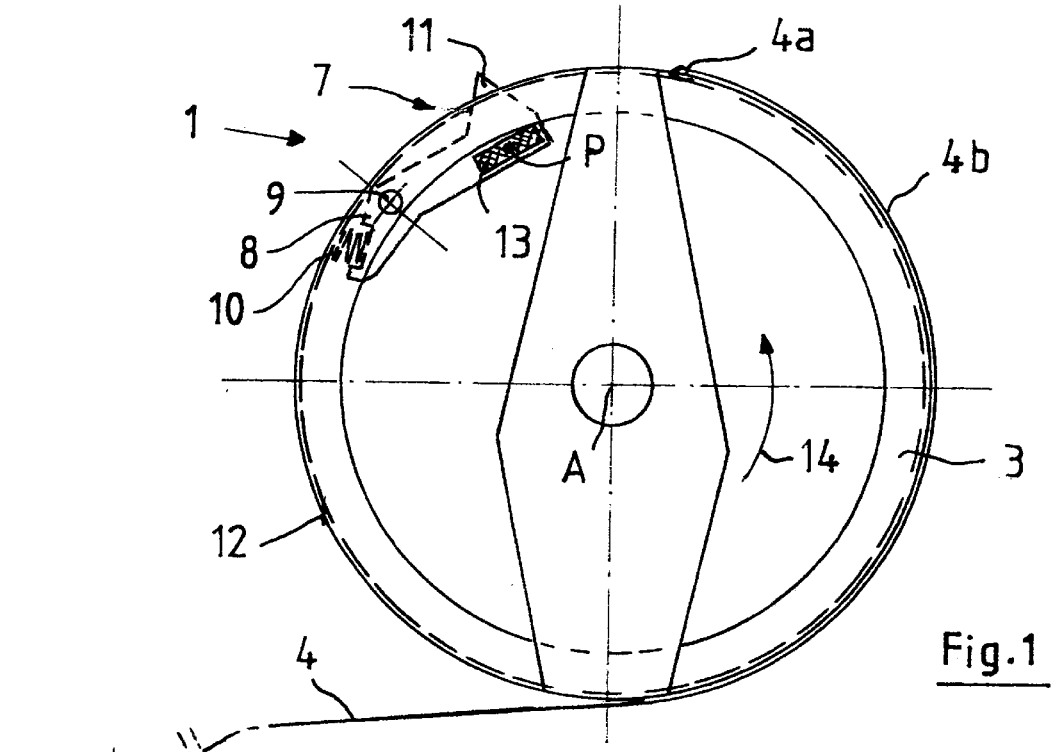
FIG. 1 shows schematically a view of the device according to the invention when empty.

The device 1 comprises a cylindrical winding drum 3 which is rotatably supported about a geometric axis A. The winding drum 3 has a mantle surface 12 on which the beginning or leading end 4*a* of a winding belt 4 is fastened. The winding belt 4 is, for example, made of plastic material and has a comparatively high tearing resistance. In the shown embodiment, according to FIG. 3, two parallel positioned winding belts 4 are provided. Conceivable is also an arrangement in which only one winding belt or more than two winding belts are provided.

For forming a coil, the drum 3 is rotated in the direction of arrow 14 by means of a drive device, not illustrated but known in the art. For this purpose, the winding belt 4 or the winding belts are removed from a winding mandrel 5. The winding mandrel 5 thus forms part of a winding belt magazine and is braked. This ensures that the required belt tension is maintained.

Figure 2:
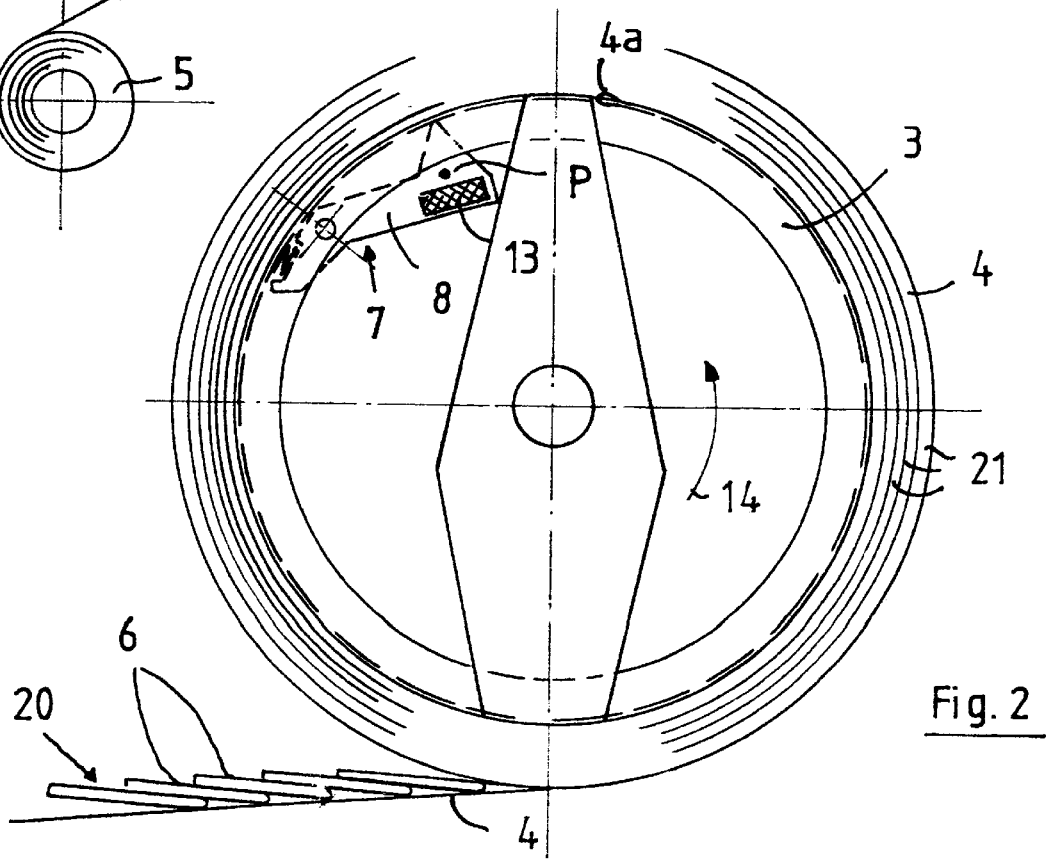
FIG. 2 shows schematically the device according to the invention in the loaded state.

When winding, the printed sheets 6, according to FIG. 2, are supplied undershot and tangentially by means of a conveying device, not illustrated, in an overlapped flow 20. The printed sheets 6 are thus wound onto the drum in an overlapped flow and form winding layers 21. Once a drum 3 is completely covered with the printed sheets 6, it is removed from the winding station for intermediate storage, for transport and/or for further processing and is then placed onto a support.

For unwinding a loaded winding drum 3, it is docked on a winding station and the winding drum 3 is rotated in a direction opposite to arrow 14. The winding belt 4 is rewound onto the winding mandrel 5. The printed sheets 6 are then removed in an overlapped flow and are supplied, for example, to a gather-stitcher for further processing. When unwinding the printed sheets 6, it is important in connection with controlling the overlapped flow 20 that the empty state is safely detected in a timely fashion. For this purpose, means 7 are arranged on the winding drum 3 for determining whether the winding drum 3 is empty or loaded. The means 7 have a two-arm lever 8 which is pivotably supported on an axle 9 on the periphery of the winding drum 3. At a spacing to the axle 9, the nose 11 is connected to the lever 8 which, in the position of the lever 8 illustrated in FIG. 1, projects through a cutout 16 past the mantle surface 12 of the winding drum 3. A pressure spring 10 engages the end of the lever 8 opposite the nose 11. The pressure spring 10 is supported on the winding drum 3 and in FIG. 1 tensions the lever 8 about the axle 9 in the counterclockwise direction. The position illustrated in FIG. 1 is limited by a stop, not illustrated.

Figure 3:
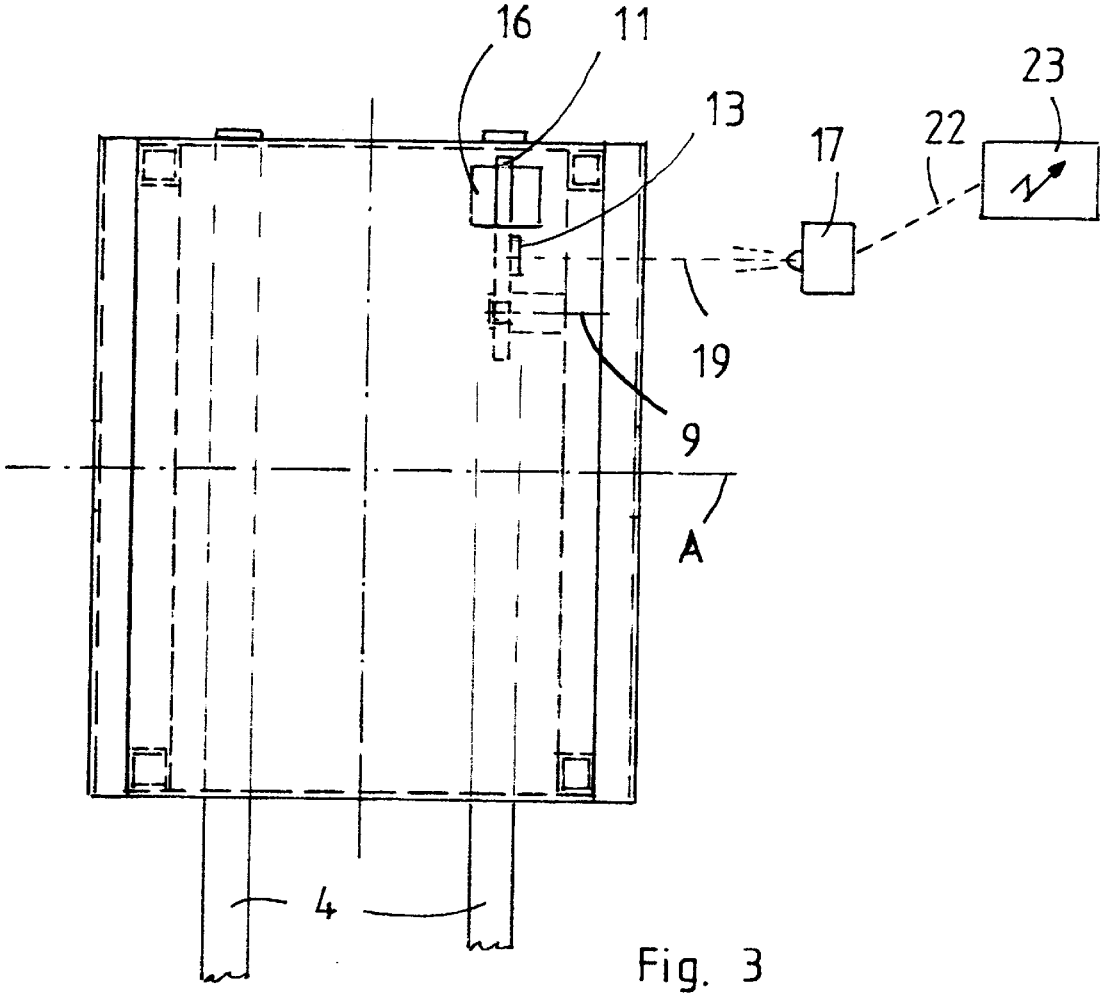
FIG. 3 shows schematically a partial view of the device according to the invention.

The lever 8 forms a touch probe and is arranged according to FIG. 3 such that it is positioned underneath one of the two winding belts 4 wound onto the winding drum 3.

A reflector 13 is laterally positioned on the lever 8 at a spacing to the axle 9 and reflects axially impinging light. A photocell 17 is fixedly arranged on the frame of the device at a spacing to this reflector 13 and directs a light beam 19 parallel and at a spacing to the axle 9 toward the winding drum 3. In FIG. 1, this photocell 17 is arranged in 11 o'clock position. When the lever 8 is in the position illustrated in FIG. 1, the light beam 19 impinges on the reflector 13. The light beam 19 is reflected on the reflector 13 and reaches again the photocell 17. Via a signal line 22 a corresponding pulse is sent to a control device 23. The location of the light beam 19 is illustrated in FIG. 1 by the point P.

When printed sheets 6 are now placed onto the empty winding drum 3, illustrated in FIG. 1, the winding drum 3 rotates in the direction of arrow 14. The lever 8 rotates correspondingly also and finally reaches the 6 o'clock position in FIG. 1. The nose 11 now engages the tensioned winding belt 4 and the tension force of the winding belt 4 forces the nose radially inwardly into the cutout 16 and, accordingly, the lever 8 is pivoted about the axle 9. The pressure spring 10 is compressed accordingly. FIG. 2 shows this position of the lever 8. Together with the lever 8, the reflector 13 is, of course, also radially moved inwardly. As illustrated in FIG. 2, the reflector 13 is now positioned external to the position of the light beam 19. During the winding action, the light beam 19 is not subjected to reflection in any of the rotational positions of the winding drum 3, and, accordingly, the photocell 17 does not receive any reflected light. During the unwinding action, the lever 8 remains in the pivoted position illustrated in FIG. 2 until the winding belt 4 rests only in a single layer thereon and is lifted off the nose 11. The lever 8 is then in the 6 o'clock position illustrated in FIG. 1. The leading end 4*a* of the belt 4 is also approximately in the 6 o'clock position. Since the lever 8 is no longer loaded by the winding belt 4, the spring 10 pivots the lever 8 into the position illustrated in FIG. 1 in which the nose 11 projects past the mantle surface 12. When the lever 8 now moves into the 11 o'clock position illustrated in FIG. 1, the reflecting strip 13 is in the range of the light beam 19. The photo cell 17 now sends a signal to the control 23 which interrupts the unwinding process. As illustrated, the empty state is recognized in a position of the winding drum 3 in which the area 4*b* of the winding belt 4 illustrated in FIG. 1 still rests against the mantle surface 12. Up to the point of complete unwinding there is still a reserve provided by the area 4*b*. Even when there is a delay for reaching the standstill position, it is ensured that the winding belt 4 will not be torn off the winding drum 3.

In the illustrated embodiment, the lever 8 is pivoted by the winding belt 4 or by one of the two winding belts 4.

While specific embodiments of the invention have been shown and described in detail to illustrate the inventive principles, it will be understood that the invention may be embodied otherwise without departing from such principles.

What is claimed is:

1. A winding device for flat printed sheets, comprising:

a rotatably supported winding drum configured to receive and dispense printed sheets;

at least one winding mandrel having a winding belt wound thereon and configured to unwind the winding belt and feed undershot the winding belt to the winding drum;

wherein the winding belt is configured to receive the printed sheets and, by being wound onto the winding drum together with the printed sheets, to form winding layers of the printed sheets on the winding drum;

a touch probe configured to detect an empty state of the winding drum, without printed sheets wound thereon, or a loaded state of the winding drum, having printed sheets wound thereon, by interacting with the winding belt or the printed sheets, wherein the touch probe is arranged on a periphery of the winding drum, wherein the periphery of the winding drum has a cutout and wherein the touch probe is a lever springily supported in the cutout, further comprising a photocell arranged external to the winding drum and configured to detect a pivot position of the lever.

2. The winding device according to claim 1, wherein the touch probe has a touch nose projecting radially outwardly past the periphery of the winding drum when the winding drum is in the empty state.

3. The winding device according to claim 1, wherein the lever has a pivot axle and a nose positioned at a spacing from the pivot axle, wherein the lever has a spring configured to pivot the lever about the pivot axle such that the nose projects radially outwardly past the periphery of the winding drum when the winding drum is in the empty state, wherein the lever is pivoted against the force of the spring radially inwardly, when the winding drum is loaded with printed sheets.

4. The winding device according to claim 1, further comprising a reflector configured to interact with the photocell.

5. The winding device according to claim 1, wherein the touch probe is positioned at a distance in front of a leading end of the winding belt in a winding direction of the winding belt such that the touch probe indicates for a predetermined residual length of the winding belt or winding layer the empty state of the winding drum.

* * * * *